US006422318B1

(12) United States Patent
Rider

(10) Patent No.: US 6,422,318 B1
(45) Date of Patent: Jul. 23, 2002

(54) HORIZONTAL WELL SYSTEM

(75) Inventor: Donald L. Rider, Portsmouth, OH (US)

(73) Assignee: Scioto County Regional Water District #1, Lucasville, OH (US)

( * ) Notice: Subject to any disclaimer, the term of this patent is extended or adjusted under 35 U.S.C. 154(b) by 0 days.

(21) Appl. No.: 09/739,925

(22) Filed: Dec. 18, 2000

Related U.S. Application Data

(60) Provisional application No. 60/172,536, filed on Dec. 17, 1999.

(51) Int. Cl.[7] ..... E21B 7/04; E21B 7/20; E21B 17/18; E21B 43/10; E21B 43/30

(52) U.S. Cl. ..... 166/380; 166/50; 166/54.1; 166/68.5; 166/85.2; 166/369; 175/61; 210/170; 405/184

(58) Field of Search ..... 166/50, 54.1, 68, 166/68.5, 85.2, 105.1, 227, 241.6, 242.6, 369, 380, 384; 175/61, 62; 210/170; 405/128.15, 174, 184

(56) References Cited

U.S. PATENT DOCUMENTS

| | | | | | |
|---|---|---|---|---|---|
| 3,338,306 | A | | 8/1967 | Cook | |
| 3,722,586 | A | * | 3/1973 | Baker | 166/85.2 |
| 3,986,557 | A | | 10/1976 | Striegler et al. | |
| 4,014,387 | A | * | 3/1977 | Fink | 166/105 |
| 4,319,648 | A | | 3/1982 | Cherrington | |
| 4,334,580 | A | | 6/1982 | Vann | |
| 4,442,896 | A | | 4/1984 | Reale et al. | |
| 4,445,574 | A | | 5/1984 | Vann | |
| 5,252,226 | A | * | 10/1993 | Justice | 210/739 |
| 5,289,888 | A | | 3/1994 | Talley | |
| 5,343,965 | A | | 9/1994 | Talley et al. | |
| 5,377,754 | A | * | 1/1995 | Keller | 166/191 |
| 5,396,950 | A | | 3/1995 | Talley et al. | |
| 5,402,851 | A | * | 4/1995 | Baiton | 166/369 |
| 5,450,902 | A | | 9/1995 | Matthews | |
| 5,597,045 | A | * | 1/1997 | Sass et al. | 166/227 |
| 5,771,976 | A | | 6/1998 | Talley | |
| 5,833,015 | A | | 11/1998 | Hesse et al. | |
| 5,937,954 | A | | 8/1999 | Puttmann et al. | |
| 6,073,659 | A | * | 6/2000 | Lange | 138/177 |

OTHER PUBLICATIONS

Ranney Method, *How a Ranney Method™ Well Works.**

* cited by examiner

*Primary Examiner*—George Suchfield
(74) *Attorney, Agent, or Firm*—Wood, Herron & Evans, L.L.P.

(57) ABSTRACT

A horizontal well system, in accordance with the principles of the invention, includes a porous casing member having an interior space, a first end, and a second end, with at least a portion of the porous casing member being positioned substantially horizontally within an aquifer. This horizontal well system further includes a first casing member and a second casing member, with each of the first and second casing members having an interior space, an outer end, and an inner end. The inner end of the first casing member is connected to the first end of the porous casing member, with the first casing member extending toward the ground surface. The inner end of the second casing member is connected to the second end of the porous casing member, with the second casing member extending toward the ground surface. The system may include a first submersible pumping assembly positioned in the interior space of the first casing member, with the first submersible pumping assembly including a first pump and a first pipe member connected to the first pump. In this fashion, water from the aquifer may be pumped through the first pipe member. The horizontal well system also may include a second submersible pumping assembly positioned in the interior space of the second casing member. The second submersible pumping assembly includes a second pump and a second pipe member connected to the second pump, whereby water from the aquifer may be pumped through the second pipe member.

20 Claims, 3 Drawing Sheets

HORIZONTAL WELL SYSTEM

CROSS-REFERENCE TO RELATED APPLICATION

This Application claims the benefit of the filing date of Provisional U.S. Patent Application No. 60/172,536 entitled "Horizontal Well" and filed on Dec. 17, 1999. The entire disclosure of Provisional U.S. Patent Application No. 60/172,536 is incorporated into this Application by reference.

BACKGROUND OF THE INVENTION

1. Field of Invention

This invention relates to wells for obtaining water, and more particularly, to wells for obtaining water from aquifers.

2. Description of the Related Art

A radial collector well as a cylindrical caisson which extends downward in a vertical orientation from a ground surface into an aquifer. A series of lateral well screens project out horizontally from the caisson into the aquifer, at one or more elevations. These screens may be placed in a variety of patterns and varying lengths, and if desired, may be equipped with an artificial gravel-pack filter. The vertically-oriented caisson is formed of reinforced concrete.

With the radial collector well, water passes from the aquifer into the lateral well screens, where the water moves into the vertically-oriented central concrete caisson. The radial collector well typically is completed with a pump house and controls, with the pump house being positioned directly atop the reinforced concrete caisson. In this fashion, water from within the vertically-oriented caisson is drawn straight up to the pump house via a pump column, under the pumping power of one or more vertical turbine pumps and motors located in the pump house.

SUMMARY OF THE INVENTION

One version of the horizontal well system includes a porous casing member having an interior space, a first end, and a second end, with at least a portion of the porous casing member being positioned substantially horizontally within an aquifer. This horizontal well system further includes a first casing member and a second casing member, with each of the first and second casing members having an interior space, an outer end, and an inner end. The inner end of the first casing member is connected to the first end of the porous casing member, with the first casing member extending toward the ground surface. The inner end of the second casing member is connected to the second end of the porous casing member, with the second casing member extending toward the ground surface.

As used in this Application, unless expressly stated otherwise, the word "connected" encompasses elements (e.g., any components or parts) which are connected either directly, or indirectly via one or more intermediate elements. The words "connect", "connects" and "connecting", as used in this Application, are to be given a similar interpretation.

If desired, the first casing member may extend toward the ground surface at an angle which is greater than 90°, relative to the portion of the porous casing member which is positioned substantially horizontally within the aquifer. Likewise, the second casing member may extend toward the ground surface at an angle which is greater than 90°, relative to the portion of the porous casing member which is positioned substantially horizontally within the aquifer.

Either the first or second casing member may extend at least to the ground surface. Alternatively, both the first and second casing members may extend at least to the ground surface.

The system may include a first submersible pumping assembly positioned in the interior space of the first casing member, with the first submersible pumping assembly including a first pump and a first pipe member connected to the first pump. In this fashion, water from the aquifer may be pumped through the first pipe member. The first casing member includes an interior surface, and the first submersible pumping assembly includes an exterior surface. If desired, the system may further include a radial spacer which contacts the interior surface and the exterior surface, thereby radially orienting the first submersible pumping assembly within the first conduit member.

The horizontal well system also may include a second submersible pumping assembly positioned in the interior space of the second casing member. The second submersible pumping assembly includes a second pump and a second pipe member connected to the second pump, whereby water from the aquifer may be pumped through the second pipe member. The second casing member includes an interior surface, and the second submersible pumping assembly includes an exterior surface. The system may further include a radial spacer which contacts the second casing member interior surface and the second submersible pumping assembly exterior surface, thereby radially orienting the second submersible pumping assembly within the second casing member.

The first casing member also may include a first cover assembly. If desired, this first cover assembly may include a pitless adapter assembly. The second casing member may include a second cover assembly. And, if desired, the second cover assembly may include a pitless adapter assembly.

The porous casing member of the horizontal well system has an elongated sidewall which extends between the porous casing member's first end and second end. The elongated sidewall of the porous casing member may include a plurality of openings. Also, the openings may include a plurality of slots.

Both the first and second casing members have an exterior surface. The horizontal well system may include a circumferential projection which projects radially outward from the first casing member exterior surface. In addition, the system may include a circumferential projection which projects radially outward from the second casing member exterior surface.

In another aspect of the invention, the horizontal well system is positioned by drilling a borehole in the ground, with the borehole having an entry point at the ground surface and a remote exit point at the ground surface. The borehole also has a first section which extends from the entry point to the aquifer, a second section which extends through a portion of the aquifer, and a third section which extends from the aquifer to the remote exit point. The positioning process further includes pulling a first casing member lower-pipe section (also referred to as a "first lower-pipe section"), a second casing member lower-pipe section (also referred to as a "second lower-pipe section"), and a porous casing member through at least a portion of the borehole, with the porous casing member being positioned between the first and second casing member lower-pipe sections. At least a portion of the porous casing member is positioned within the aquifer.

The drilling step may include drilling at least a portion of the second section through the aquifer in a substantially horizontal orientation. The pulling step may include pulling the first lower-pipe section, second lower-pipe section, and porous casing member through the remote exit point toward the entry point.

BRIEF DESCRIPTION OF THE DRAWINGS

The accompanying drawings, which are a part of this specification, illustrate various versions of the invention, and, together with the general description of the invention given above, and the detailed description of the drawings given below, help to explain the principles of the invention.

DETAILED DESCRIPTION OF THE DRAWINGS

Figure 1:
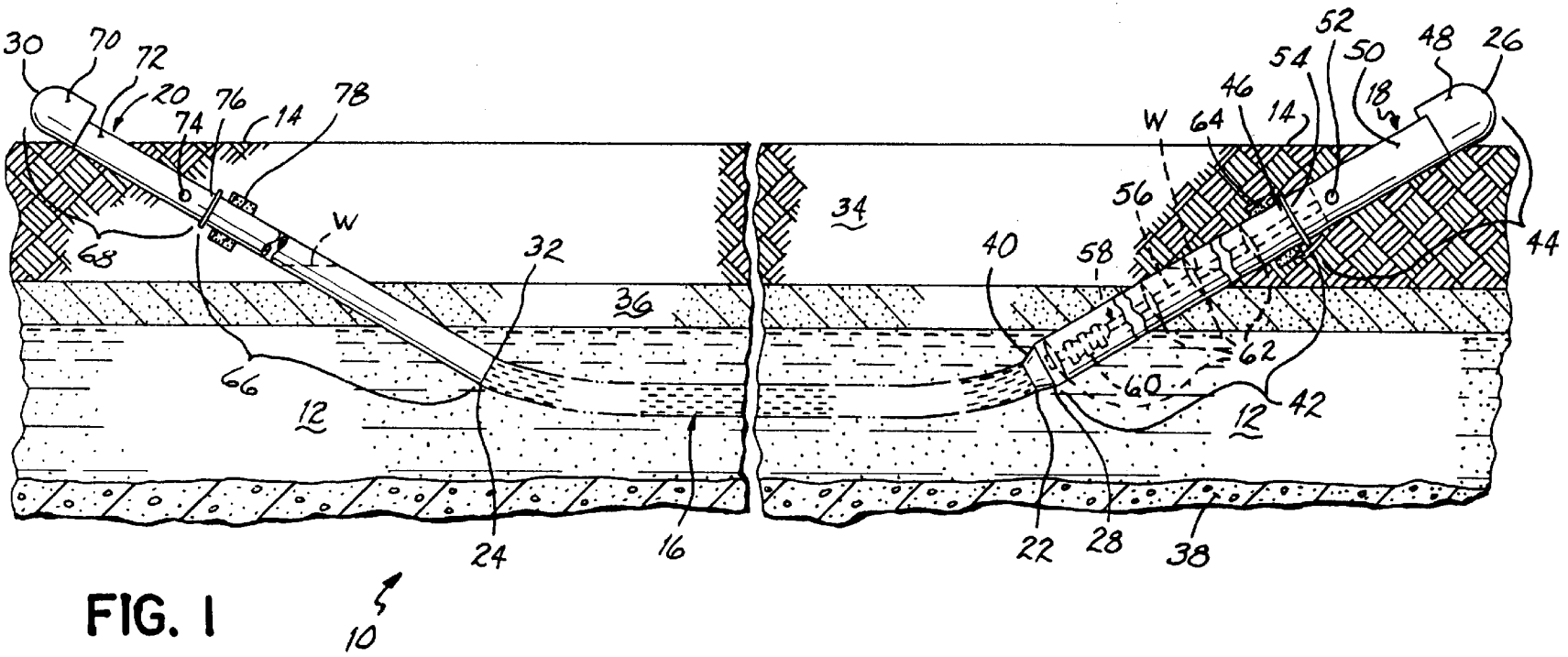
FIG. 1 is a fragmented, side elevational view of one version of the invention.

FIG. 1 depicts a version of the horizontal well system 10 positioned in an area of ground having an aquifer 12 and a ground surface 14. As shown, this particular horizontal well system 10 includes a porous casing member 16 positioned between, and connected to, a first casing member 18 and a second casing member 20. In further detail, the porous casing member 16 has an interior space (not shown), a first end 22, and a second end 24, with the porous casing member 16 being positioned substantially horizontally within the aquifer 12. The first casing member 18 has an interior space, an outer end 26, and an inner end 28, with the inner end 28 being connected to the porous casing member first end 22. The second casing member 20 has an interior space (not shown), an outer end 30, and an inner end 32, with the inner end 32 being connected to the porous casing member second end 24. Each of the first and second casing members 18, 20 extends toward, and projects slightly above, the ground surface 14.

As shown, the ground includes a number of different layers. Starting from the ground surface 14 and working downward, the ground includes a soil layer 34, a compressed sand and gravel layer 36, a sand-and-gravel aquifer 12, and an underlying bedrock layer 38.

The porous casing member 16 is a well screen having elongated slots which allow for the passage of water from the aquifer 12 into the interior space of the well screen, first casing member 18, and second casing member 20, as seen by the water line W. Because the cross-sectional diameter of the porous casing member 16 is somewhat smaller than that of the first casing member 18, a tapered pipe reducer section 40 connects the first end 22 of the porous casing member 16 to the inner end 28 of the first casing member 18. However, a tapered pipe reducer section is not used to connect the second end 24 of the porous casing member 16 to the inner end 32 of the second casing member 20, because the second casing member 20 has a cross-sectional diameter which is similar to that of the porous casing member 16.

In further detail, the first casing member 18 has a first lower-pipe section 42 connected to a first cover assembly 44, with the first cover assembly being in the form of a first pitless adapter assembly. The first lower-pipe section 42 has a peripheral flange (not shown) at its upper end 46. The pitless adapter assembly 44 has a pitless cap 48 releasably connected to a pitless case 50. The pitless case 50 has a discharge opening in a portion of the circumferential sidewall of the case 50, and a peripheral flange (not shown) at the base 54 of the pitless case 50. The discharge opening 52 may be used to transport water from the horizontal well system 10, and the peripheral flange may be used to releasably attach the pitless adapter assembly 44 to the peripheral flange of the first lower-pipe section 42. The pitless adapter assembly 44 further has a first pipe member 56, which is positioned within the interior space of the first casing member 18, and which extends toward the porous casing member 16. This first pipe member 56 is discussed in further detail immediately below.

The first casing member 18 contains a first submersible pumping assembly 58, which is positioned within the interior space of the member 18. The first submersible pumping assembly 58 includes a first pump 60 which is connected to the first pipe member 56. In further detail, the first pipe member 56 has an inner end and an outer end (not shown), with the first pump 60 being connected to the inner end of the first pipe member 56. The first casing member 18 further contains a series of radial spacers 62 in the form of casing insulators. These radial spacers 62 are positioned at various points along the length of the first submersible pumping assembly 58, with each radial spacer 62 contacting the interior surface of the first casing member 18 and the exterior surface of the first submersible pumping assembly 58, thereby assisting in orienting the first submersible pumping assembly 58 substantially coaxially within the first casing member 18. When the first pump 60 is turned on, the first submersible pumping assembly 58 serves to pump water from the interior space of the first casing member 18 and/or porous casing member 16, through the first pipe member 56, and to the discharge opening 52.

As shown in FIG. 1, the horizontal well system 10 also has a circumferential projection 64 in the form of a concrete seal which projects radially outward from the exterior surface of the first casing member 18. The circumferential projection 64 is positioned within the soil layer 34, along the length of the first lower-pipe section 42 just below the peripheral flange, and assists in inhibiting ground surface water from traveling along the exterior surface of the first casing member 18 into the aquifer 12.

The second casing member 20 includes its own lower-pipe section 66 (the second lower-pipe section) and cover assembly 68, with the cover assembly 68 being in the form of a second pitless adapter assembly. The pitless adapter assembly 68 has a pitless cap 70 releasably connected to a pitless case 72, with the pitless case 72 including a discharge opening 74 and a flange at the base 76. A circumferential projection 78, in the form of a concrete seal, projects radially outward from the exterior surface of the second lower-pipe section 66, and is positioned just beneath the flange, within the soil layer 34 of the ground.

This version of the horizontal well invention 10 offers many benefits and advantages over existing wells. For example, because the porous pipe member 16 may extend several hundred feet, and even several thousand feet, within the aquifer 12, it provides an exposed (to the saturated thickness of the aquifer) surface which is far greater than that of existing wells. Therefore, the horizontal well system is far more effective in accessing water from the aquifer 12. Also, because of the extraordinarily large, cumulative surface area of the openings or slots along the length of the porous casing member 16 (in this version, a well screen), the velocity of water moving from the aquifer 12 through the slots and into the interior of the porous casing member 16 is dramatically reduced. This unexpected and surprising benefit of the horizontal well system 10 means that the well needs to be cleaned far less frequently than existing wells. Because the water velocity is dramatically reduced, the amount of time it takes for slots to become blocked with sand, gravel, and the like is much greater than with existing wells. Accordingly, the horizontal well system 10 is not only more effective at "tapping into" the source of water (i.e., the saturated thickness of the aquifer), but also is far more efficient in its operation, and for a significantly enhanced length of time, relative to existing wells, because of the extraordinarily low velocity of water through the well screen slots.

In addition, if and when cleaning of the interior of the well is required, the dual-access-point feature of the horizontal well system 10 offers a tremendous advantage over the single access point of existing wells. In further detail, whereas existing wells provide a single well-access-point above the ground surface, the first pitless adapter assembly pitless cap 48 of the horizontal well system provides a first above-ground access point to the well interior, and the second pitless adapter assembly pitless cap 70 offers a second above-ground access point to the interior of the well. Accordingly, the interior of the well system 10, and especially the well screen 16, may be cleaned from either the first end or the second end. This design also allows for the porous casing member 16, including the well screens slots, to be cleaned without the use of harsh chemicals. In further detail, an interior-surface scrubbing device may be positioned at either end of the well system 10, and subsequently pulled or pushed through the entire length of the well system 10.

Figure 2:
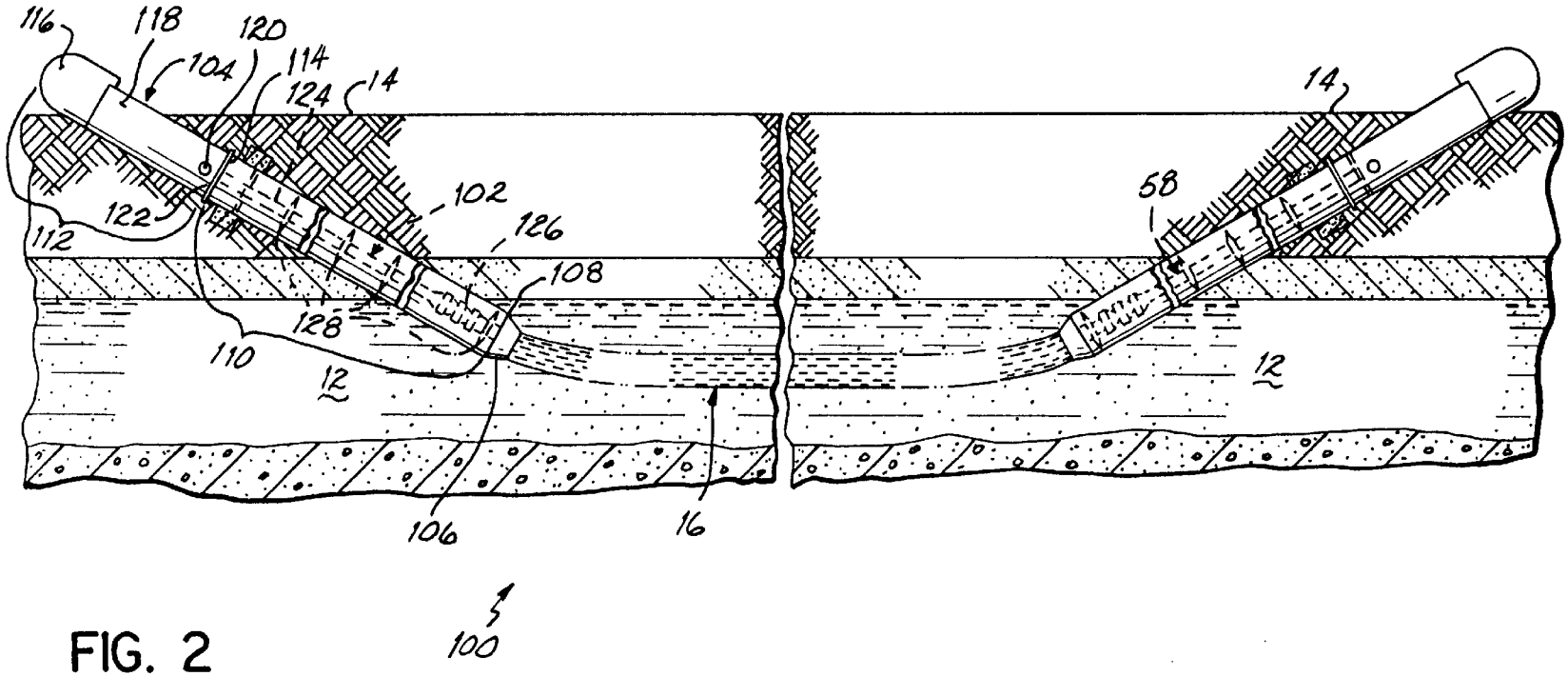
FIG. 2 is a fragmented, side elevational view of another version of the invention.

FIG. 2 depicts another version of the horizontal well system 100 positioned in an area of ground having an aquifer 12 and a ground surface 14.

This particular version of the well system 100 is similar to the version 10 discussed above, with the exception of the second casing member and the components positioned within the second casing member. Because of the similarities between the two versions, only the aspects of this version 100 which are different from the preceding version 10 are discussed in detail below. Also, any of the components which are discussed below, and which are identical in both versions, are identified by the same reference numbers.

As shown in FIG. 2, this version of the horizontal well system 100 has not only a first submersible pumping assembly 58, but also a second submersible pumping assembly 102. The second submersible pumping assembly 102 is positioned within a second casing member 104. The second casing member 104 has a cross-sectional diameter which is greater than that of the porous casing member 16, and therefore, a tapered pipe reducer section 106 is used to connect the second end 24 of the porous casing member to the inner end 108 of the second casing member 104.

In further detail, the second casing member 104 has a second lower-pipe section 110 connected to a second cover assembly 112, with the second cover assembly 112 being in the form of a second pitless adapter assembly. The second lower-pipe section 110 has a peripheral flange at its upper end 114. The pitless adapter assembly 112 has a pitless cap 116 releasably connected to a pitless case 118. The pitless case 118 has a discharge opening 120 extending from a portion of the circumferential sidewall of the case 118, and a peripheral flange at the base 122 of the pitless case 118. The discharge opening 120 may be used to transport water from the horizontal well system 100, and the peripheral flange may be used to releasably attach the pitless adapter assembly 112 to the peripheral flange of the second lower-pipe section 110. The pitless adapter assembly 112 further has a second pipe member 124, which is positioned within the interior space of the second casing member 104, and which extends toward the porous casing member 16. This second pipe member 124 is discussed in further detail immediately below.

The second submersible pumping assembly 102 is positioned within the interior space of the second casing member 104, and includes a second pump 126 which is connected to the second pipe member 124. In further detail, the second pipe member 124 has an inner end and an outer end (not shown), with the second pump 126 being connected to the inner end of the second pipe member 124. The second casing member 104 further contains a series of radial spacers 128 in the form of casing insulators. These radial spacers 128 are positioned at various points along the length of the second submersible pumping assembly 102, with each radial spacer 128 contacting the interior surface of the second casing member 104 and the exterior surface of the second submersible pumping assembly 102, thereby assisting in orienting the second submersible pumping assembly 102 substantially coaxially within the second casing member 104. When the second pump 126 is turned on, the second submersible pumping assembly 102 serves to pump water from the interior space of the second casing member 104 and/or porous casing member 16, through the second pipe member 124, and to the discharge opening 120 of the second pitless adapter assembly 112.

This version of the horizontal well system 100 provides several benefits and advantages. For example, water may be drawn simultaneously from both the first and second casing members 18, 104, thereby allowing for increased water production. Alternatively, an operator may switch back and forth between the two pumps 60, 126, thereby extending the time between pump maintenance sessions. Also, because of the dual-pump design, the well may continue to produce water, even when one pump is removed for servicing or maintenance.

Figure 3:
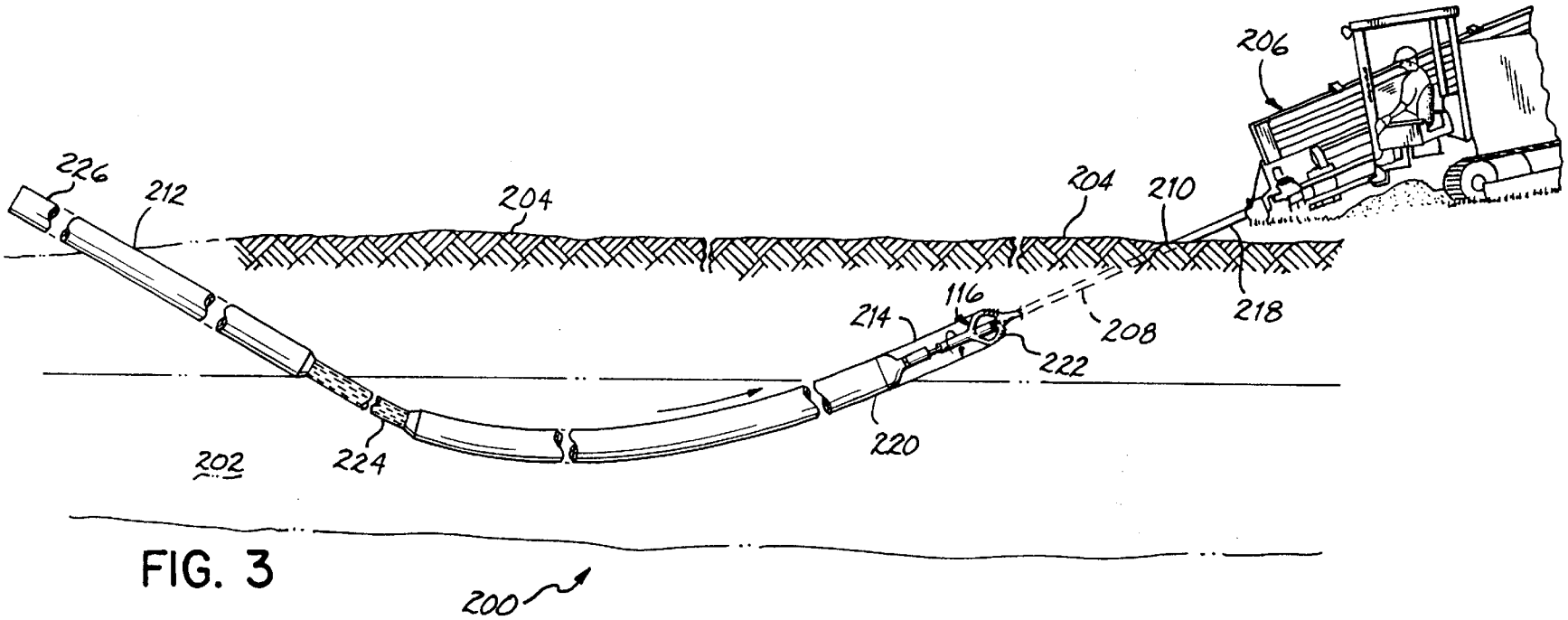
FIG. 3 is a fragmented, side elevational view of a casing subassembly being positioned in the ground.

FIG. 3 depicts a casing subassembly 200 of a horizontal well system being positioned in an area of ground having an aquifer 202 and a ground surface 204. Using commercially available directional drilling equipment 206, an operator drills a preliminary borehole 208 in the ground, with the borehole 208 having an entry point 210 at the ground surface 204, a remote exit point 212 at the ground surface 204, a first section which extends from the entry point 210 to the aquifer 202, a second section which extends through a portion of the aquifer 202, and a third section which extends from the aquifer 202 to the remote exit point 212.

As shown in FIG. 3, the step of drilling the preliminary borehole 208 in the ground already has been performed using the directional drilling equipment 206. At this point, an operator of the equipment 206 simultaneously forms an enlarged-diameter borehole 214 and pulls the casing subassembly 200 through that enlarged borehole 214, from the remote exit point 212 toward the entry point 210. In order to accomplish the simultaneous actions, the operator or another worker attaches a pull-back assembly 216 to the outermost push rod 218 of the directional drilling equipment 206 and to the first lower-pipe section 220. The pull-back assembly 216 includes a backreamer 222 which serves to enlarge the originally-formed borehole 208, thereby making it possible for the casing subassembly 200 to be pulled back from the remote exit point 212 toward the entry point 210. As shown, the casing subassembly 200 includes the first lower-pipe section 220 connected to the first end of the porous casing member 224, and the second lower-pipe section 226 connected to the second end of the porous casing member 224. The pull-back operation continues until the operator achieves the desired positioning of the porous casing member 224 within the aquifer 202.

EXAMPLE

A version of the horizontal well system is made in the following manner. Directional drilling equipment, such as the Navigator™ D50x100A from the Vermeer Manufacturing Company of Pella, Iowa, is used to drill a borehole in an area of ground having an aquifer and a ground surface. The drilling is performed such that the borehole has an entry point at the ground surface, a remote exit point at the ground surface, a first section which extends from the entry point to the aquifer, a second section which extends through a portion of the aquifer, and a third section which extends from the aquifer to the remote exit point. If desired, a boring solution or slurry may be used in the directional drilling process, with one such material being VariFlo QD, which is available from SETCO of Arlington Heights, Ill.

Prior to pulling the casing subassembly back through the newly-formed borehole, the appropriate casing components are brought to the well site. In the particular horizontal well system described in this Example, the first casing member includes a first lower-pipe section formed of high density polyethylene ("HDPE"). In further detail, this first lower-pipe section is approximately 70 feet in length, has a cross-sectional diameter of about 24 inches, and may be made up of several subsections fused together. In addition, this section has a standard dimension ratio ("SDR") of eleven. Such piping typically has a pressure rating of 160 pounds per square inch ("PSI") and is commercially available from the Plexco Division of the Chevron Chemical Company under the product name PE 3408. Such piping is also available from CSR PolyPipe under the product code PE 3408.

The porous casing member is approximately 600 feet of HDPE well screen having a cross-sectional diameter of about 16 inches and an SDR of eleven. The well screen pipe section may be made up of several subsections fused together. If desired, the well screen pipe may have approximately 25 rows of slots distributed along the circumferential sidewall of the well screen pipe and aligned with the longitudinal axis of the well screen piping. Also, each screen slot in a given row may have a length of about five inches and be separated from an adjacent slot in the same row by about 2.5 inches. In addition, each screen slot may have a width or height of about 0.07 inches. Further, if desired, each row of slots may be spaced from an adjacent row by about 1.827 inches. Such well screen pipe is available from the Atlantic Screen, Inc. of Milton, Del. Such well screen pipe also is available from Jayco Screen, Inc. of Pensacola, Fla., as well as from Titan Industries. The Titan Industries products are sold under the product names Ver-Ta Slot and Sure-Drain.

The second casing member has a second lower-pipe section. This section is identical to that of the first casing member, with one exception. Whereas the first lower-pipe section has a cross-sectional diameter of approximately 24 inches, the second lower-pipe section has a cross-sectional diameter of approximately 16 inches.

The three pipe sections described in the preceding three paragraphs are fused together using commercially available fusing equipment. If desired, the three sections may be fused together prior to pulling any of the sections back through the previously-formed borehole. Alternatively, a given pipe section may be pulled part-way into the borehole, leaving an exposed outer end, at which point, the exposed outer end may be fused to an adjacent pipe section. Because the first lower-pipe section has a 24 inch diameter, whereas the well screen pipe section has a 16 inch diameter, an HDPE pipe reducer section is used to connect the first lower-pipe section to the well screen pipe. In further detail, the pipe reducer section tapers from a diameter of approximately 24 inches at one end to a diameter of approximately 16 inches at an opposite end. Accordingly, the large end of the pipe reducer section is fused to the first lower-pipe section, and the smaller end of the pipe reducer section is fused to the well screen pipe. Because the well screen pipe and the second lower-pipe section have identical cross-sectional diameters, they may be fused together without the use of a pipe reducer section.

Prior to pulling the various pipe sections back through the borehole, the boring head is removed from the outer-most end of the directional drilling rods, and replaced by a backreamer and a linkage mechanism connecting the backreamer to the pipe section of the first casing member. One such backreamer is the Ditch Witch® Three-Winged Rock™ backreamer available from The Charles Machine Works, Inc. of Perry, Okla. The backreamer is activated and pulled back through the previously-formed borehole, thereby enlarging the diameter of the borehole and pulling the various pipe sections into position within the borehole. This pull-back process continues until the well screen pipe section is positioned in its intended location within the aquifer. If desired, a boring solution or slurry, for example, the VariFlow QD slurry described above, may be used during this pull-back process.

With the three fused pipe sections in position within the ground, the soil adjacent the entry point and the remote exit point may be excavated down to a level which exposes the upper end of the first lower-pipe section and the upper end of the second lower-pipe section. Alternatively, this step may already have been performed prior to or during the pull-back process. With each of the upper ends exposed, an annular flange may be fused or otherwise attached to the upper end of the first and second lower-pipe sections. Each flange serves as a connection point for secure attachment of a corresponding flange at the base of the first and second casing member pitless adapter assemblies.

Prior to filling in the excavated portions of soil adjacent the entry point and remote exit point, a radially projecting, circumferential concrete seal is formed around the exterior sidewall of each of the first and second lower-pipe sections, adjacent the first and second lower-pipe section flanges. If desired, each concrete seal may have a length, as measured along the length of the corresponding pipe section, of about three feet.

Each pitless adapter assembly is securely attached to its corresponding pipe section. The pitless adapter assemblies are attached to the upper end of the first and second lower-pipe sections either before, during, or after completion of the formation of the concrete seals. Prior to the attachment of the first pitless adapter assembly to the upper end of the first lower-pipe section, the submersible pumping assembly is securely fastened to the first pitless adapter assembly. The submersible pumping assembly includes a submersible pump and pump motor, which are connected to a water conveying pipe, also referred to as a pipe member, which is connected to the discharge pipe of the first pitless adapter assembly.

Before sliding the submersible pumping assembly into the interior space of the first lower-pipe section, a series of radial spacers, in the form of casing insulators, are positioned along the length of the submersible pumping assembly. Such casing insulators are available from Calpico Inc. of San Francisco, Calif. under the model code "PX". With the casing insulators positioned along the length of the submersible pumping assembly, the pumping assembly is guided downward into the interior space of the first lower-pipe section, until the flange at the upper end of the lower-pipe section meets with the flange of the pitless adapter assembly. At this point, the lower-pipe section and the pitless adapter assembly are releasably secured to each other, thereby forming the first casing member. Power is supplied to the pumping assembly via a power line which is run through the pitless adapter assembly. The discharge pipe of the pitless adapter assembly then is connected to any suitable, commercially-available water piping which is used to transport water to a storage facility, a treatment facility, or the like. Once these connections have been completed, the excavated soil may be returned to this area, thereby creating a finished ground surface.

The second pitless adapter assembly is connected to the upper end of the second lower-pipe section in a similar manner. However, because, in this particular version, the second casing member does not include a submersible pumping assembly, the steps described above in connection with a submersible pumping assembly are omitted. In addition, the discharge pipe or outlet of the second pitless adapter assembly is releasably sealed. With the second pitless adapter assembly now releasably attached to the second lower-pipe section, the second casing member is thereby completed.

What is claimed is:

1. A horizontal well system positioned in an area of ground having an aquifer and a ground surface, the horizontal well system comprising:

a porous casing member having an interior space, a first end, and a second end, at least a portion of the porous casing member being positioned substantially horizontally within an aquifer;

a first casing member having an interior space, an outer end, and an inner end, the inner end being connected to the porous casing member first end, and the first casing member extending toward the ground surface; and a second casing member having an interior space, an outer end, and an inner end, the inner end being connected to the porous casing member second end, and the second casing member extending toward the ground surface.

2. The system of claim 1 wherein the first casing member extends toward the ground surface at an angle which is greater than 90 degrees, relative to the portion of the porous casing member which is positioned substantially horizontally within the aquifer.

3. The system of claim 2 wherein the second casing member extends toward the ground surface at an angle which is greater than 90 degrees, relative to the portion of the porous casing member which is positioned substantially horizontally within the aquifer.

4. The system of claim 1 wherein the first casing member extends at least to the ground surface.

5. The system of claim 4 wherein the second casing member extends at least to the ground surface.

6. The system of claim 1 further including a first submersible pumping assembly positioned in the interior space of the first casing member, the first submersible pumping assembly including a first pump and a first pipe member connected to the first pump, whereby water from the aquifer may be pumped through the first pipe member.

7. The system of claim 6 wherein the first casing member includes an interior surface, and the first submersible pumping assembly includes an exterior surface, the system further including a radial spacer which contacts the interior surface and the exterior surface, thereby radially orienting the first submersible pumping assembly within the first conduit member.

8. The system of claim 6 further including a second submersible pumping assembly positioned in the interior space of the second casing member, the second submersible pumping assembly including a second pump and a second pipe member connected to the second pump, whereby water from the aquifer may be pumped through the second pipe member.

9. The system of claim 8 wherein the second casing member includes an interior surface, and the second submersible pumping assembly includes an exterior surface, the system further including a radial spacer which contacts the second casing member interior surface and the second submersible pumping assembly exterior surface, thereby radially orienting the second submersible pumping assembly within the second casing member.

10. The system of claim 1 wherein the first casing member includes a first cover assembly.

11. The system of claim 10 wherein the first cover assembly includes a pitless adapter assembly.

12. The system of claim 10 wherein the second casing member includes a second cover assembly.

13. The system of claim 12 wherein the second cover assembly includes a pitless adapter assembly.

14. The system of claim 1 wherein the porous casing member has an elongated sidewall extending between its first end and its second end, the elongated sidewall including a plurality of openings.

15. The system of claim 14 wherein the plurality of openings includes a plurality of slots.

16. The system of claim 1 wherein the first casing member has an exterior surface, the system further including a circumferential projection which projects radially outward from the first casing member exterior surface.

17. The system of claim 16 wherein the second casing member has an exterior surface, the system further including a circumferential projection which projects radially outward from the second casing member exterior surface.

18. A method of making a horizontal well system positioned in an area of ground having an aquifer and a ground surface, comprising the steps of:

drilling a borehole in the ground, with the borehole having an entry point at the ground surface, a remote exit point at the ground surface, a first section which extends from the entry point to the aquifer, a second section which extends through a portion of the aquifer, and a third section which extends from the aquifer to the remote exit point;

pulling a first casing member lower-pipe section, a second casing member lower-pipe section, and a porous casing member through at least a portion of the borehole, the porous casing member being positioned between the first and second casing member lower-pipe sections, whereby at least a portion of the porous casing member is positioned within the aquifer.

19. The method of claim 18 wherein the drilling step includes drilling at least a portion of the second section through the aquifer in a substantially horizontal orientation.

20. The method of claim 18 wherein the pulling step includes pulling the first lower-pipe section, second lower-pipe section, and porous casing member through the remote exit point toward the entry point.

* * * * *

UNITED STATES PATENT AND TRADEMARK OFFICE

CERTIFICATE OF CORRECTION

PATENT NO. : 6,422,318 B1
DATED : July 23, 2002
INVENTOR(S) : Donald L. Rider

It is certified that error appears in the above-identified patent and that said Letters Patent is hereby corrected as shown below:

Column 1,
Line 16, "A radical collector well as a cylindrical caisson which extends downward in a vertical orientation from a ground surface into an aquifer." should read -- A radical collector well is a cylindrical caisson which extends downward in a vertical orientation from a ground surface into an aquifer. --.

Column 4,
Line 53, "well system is for" should read -- well system 10 is for --.

Column 5,
Line 12, "well system provides" should read -- well system 10 provides --.
Line 25, "12 and a ground surface 14. ¶This particular version" should read -- 12 and a ground surface 14. This particular version --.

Column 7,
Line 40, "about 0.07 inches." should read -- about 0.07 inch. --
Line 42, "available from the Atlantic Screen, Inc., of" should read -- available from Atlantic Screen, Inc., of --.

Signed and Sealed this

Thirty-first Day of December, 2002

JAMES E. ROGAN
*Director of the United States Patent and Trademark Office*